United States Patent [19]

Erschens

[11] 4,194,725

[45] Mar. 25, 1980

[54] VEHICLE JACK

[75] Inventor: Willi Erschens, Schillingen, Fed. Rep. of Germany

[73] Assignee: Firma August Bilstein, Ennepetal, Fed. Rep. of Germany

[21] Appl. No.: 1,541

[22] Filed: Jan. 8, 1979

[30] Foreign Application Priority Data

Jan. 16, 1978 [DE] Fed. Rep. of Germany ..... 2801735

[51] Int. Cl.[2] ..... B66F 3/12

[52] U.S. Cl. ..... 254/126

[58] Field of Search ..... 254/122, 124, 126, 133, 254/DIG. 4

[56] References Cited

U.S. PATENT DOCUMENTS

| | | | |
|---|---|---|---|
| 3,746,307 | 7/1973 | Yamazaki | 254/126 |
| 3,989,225 | 11/1976 | Keilholz | 254/126 |

*Primary Examiner*—Robert C. Watson

*Attorney, Agent, or Firm*—Neuman, Williams, Anderson & Olson

[57] ABSTRACT

A vehicle jack having a support leg (10) on which is pivotable a support arm (23) by means of a threaded spindle (17) which is pivotally mounted in both the support leg and the support arm. A support plate (26) which may be provided with a depression (28) for receiving a fold (29) of a vehicle body is pivotally mounted on the free end of the support arm about a pivot axis (34).

13 Claims, 3 Drawing Figures

Fig. 2
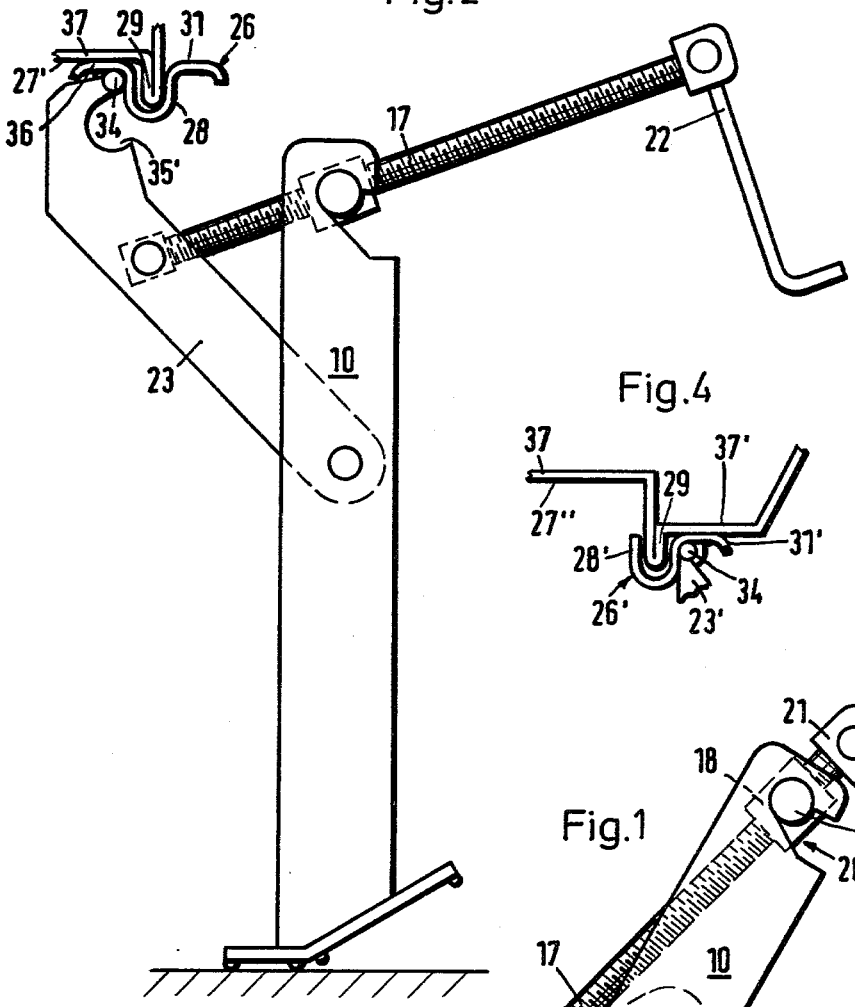
Fig. 4
Fig. 1
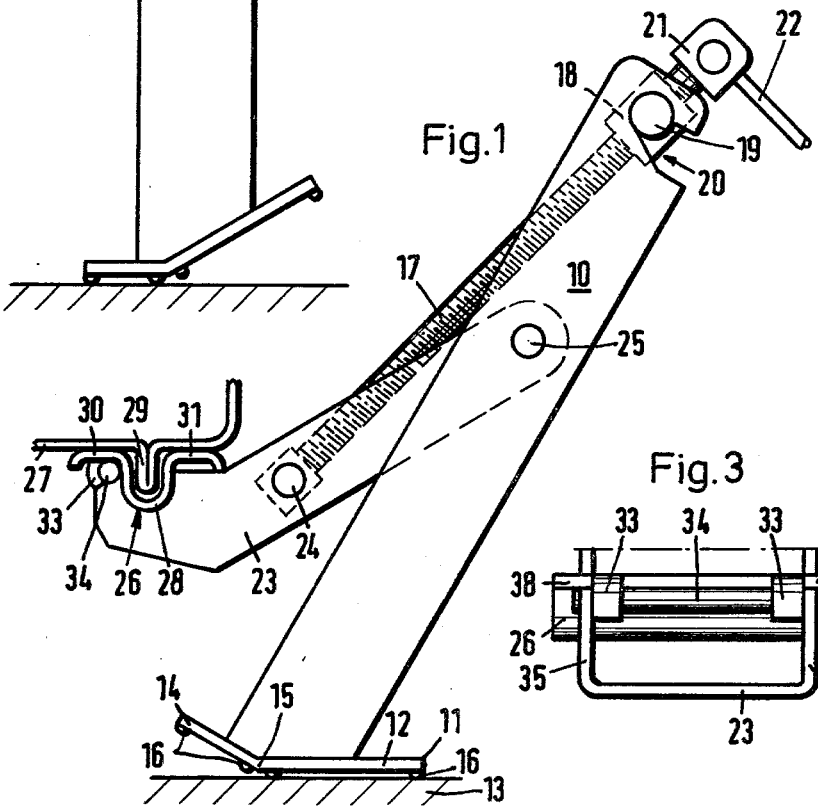
Fig. 3
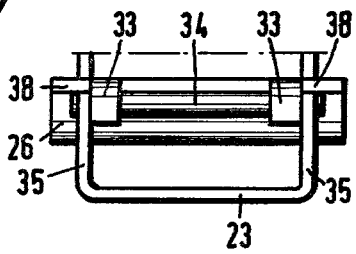

VEHICLE JACK

DESCRIPTION

This invention relates to a vehicle jack and particularly to a vehicle jack of the type having a support leg and a support arm pivotally supported thereon for movement about a pivot axis by a handle-operated threaded spindle running in a spindle nut and a spindle bearing pivotably mounted one in each of the upper end of the support leg and the support arm the support plate having a support plate at its free end which is for setting against a vehicle floor and at a load carrying point thereof and is supported on the support arm about an axis of rotation parallel to the said pivot axis.

A support plate of a known such jack includes side walls arranged perpendicularly on two opposite edges of a supporting base by which it supports itself on a pivot axis spaced from the base. This spacing is necessary in order that a protrusion on the vehicle floor can be received in a depression present in a plate base and the side walls, so that the plate base is located on both sides of the protrusion against the vehicle floor. Such a carrying plate or such a load head is too expensive in a jack of the aforementioned type which must be constructed as simply as possible on cost grounds. In addition it has a negative influence on the sureness of support of the jack under certain circumstances.

In the same publication a jack is described whose load head is arranged pivotally movable in the same way on the free end of the support arm but which has an insert pin for insertion in a socket located on a vehicle floor. Such a load head is in fact effective from the point of view of the security of support of the jack but is relatively expensive in production and, in addition, is not free of bending moments. It must therefore be constructed correspondingly stronger. Furthermore, the socket on the vehicle floor is a further expensive constructional element.

In accordance with the present invention there is provided a vehicle jack having a support leg and a support arm pivotably supported thereon for movement about a pivot axis by a handle-operated threaded spindle running in a spindle nut and a spindle bearing pivotably mounted one in each of the upper end of the support leg and the support arm, the support arm having a support plate at its free end remote from the support by which is for setting, in use, against a vehicle floor at a load carrying point thereof and is supported on the support arm about an axis of rotation parallel to the said pivot axis, said axis of rotation lying immediately adjacent the underside of the support plate with respect to the vehicle floor.

The location of the axis of rotation immediately adjacent the underside of the support plate improves the security of location of the vehicle on the movable support plate and on the support arm.

The support plate may be either completely flat or conformed to a projection of the vehicle floor. It can therefore and for example have a half spherical impression directed away from the vehicle floor with which it engages a corresponding protrusion of the vehicle floor. Since folds and folded joints are widely used in vehicles, the support plate may advantageously be provided with a V- or U-shaped depression for receiving such a protrusion of a vehicle floor. The axis of rotation may lie behind the depression in the support plate with respect to the support leg so that the jack can also be used with those shapes of body work in which no load accepting face is present on the body in front of the protrusion of the vehicle floor.

In one construction embodying the invention the means defining the axis of rotation is surrounded by two tongues formed out of the support face of the support plate. This assures a simple construction from a large faced support plate. The tongues formed out of the support plate may be arranged either both on the inner face or both on the outer face of side walls of a V-shaped support arm so that a seating of the support plate free of sideways sliding is obtained. The support plate may have a stop cooperating with the support arm and limiting its hinging movement directed away from the support arm so that operational safety is improved since the support plate cannot get into a hanging position directed downwardly out of which the operator must hinge it again upwardly.

The axis of rotation may be defined by a cylindrical pin fixed by its ends in the side walls of the U-shaped support arm. The means defining the axis of rotation can nevertheless have other constructional forms and, for example, be formed by supporting areas of the side walls of the U-shaped support arm which are formed with openings which receive protrusions on side tongues of the support plate embracing the side walls.

In order not to limit the necessary range of movement of the support plate, a recess corresponding to the depression in the support plate may be present in the respective side walls of a U-shaped support arm.

The invention will now be further explained by reference to exemplary embodiments shown in the drawings in which, FIG. 1 is a side view of a jack embodying the invention in its initial position against a motor vehicle, FIG. 2 is a side view of the jack of FIG. 1 but with the motor vehicle in a lifted position, FIG. 3 is a front view of the support arm of the jack of FIG. 1, and;

FIG. 4 is a side view of a load head of another jack embodying the invention.

The jack of FIGS. 1 to 3 has a support leg 10 to whose lower end a rolling foot 11 is firmly fixed. During positioning of the jack against a motor vehicle the jack is placed on the ground by means of the locating plate 12 of the rolling foot. The rolling foot has in addition a stand plate 14 arranged at an angle to the locating plate 12. The rolling foot is provided at the free end of its plates and adjacent to the rolling edge 15 with projections turned towards the ground 13 to improve the resistance to sliding.

A threaded spindle 17 is pivotably movably supported at the upper end of the U-shaped support leg 10 with the help of a spindle nut 18 which receives the spindle 17 and has its pins 19 located in slits 20 of the side walls of the U-shaped support leg 10. A pivot block 21 is fixed to the upper end of the threaded spindle 17 and receives a hand lever 22 with which the threaded spindle can be screwed up or screwed back as required by changing the hinging position of the hand lever in the pivot block 21.

At the other end of the threaded spindle 17 the support arm 23 is pivoted by means of a spindle support which is not further illustrated, but which may be, for example a roller bearing whose one support plate is attached to the threaded spindle and whose other support plate has pins 24 which engage in the side walls of the U-shaped support arm 23.

The support arm 23 is pivotally mounted on its support leg end on the support leg 10 by way of a pivot pin 25 and is subject to pivoting movements relative to the support leg about a pivot axis defined by the pivot pin in accordance with the operation of the threaded spindle 17.

At the free end of the support arm 23 spaced away from the support leg 10 a support plate 26 having a limited hinging movement is arranged and for setting against a vehicle floor 27. The support plate 26 has a depression 28 for receiving the protruding fold 29 of the vehicle floor. On both sides of the depression of the support plate are support faces 30, 31 which lie against the vehicle floor 27 in such a way that the fold 29 stays clear of the support plate. In order to reduce any flattening of the vehicle floor the support faces 30, 31 are made as large as possible and, preferably the support faces lying to the right and left of the pin 34 defining the axis of rotation of the plate 26 are made of equal size to obtain equal loading of the support plate as required.

The support of the support plate 26 is obtained by way of a pin 34 whose axis is parallel to the pivot axis 25 and is arranged to lie in approximately the same horizontal plane as the depression 28 and is fixed fast to the support arm 23. The pivoting connection between the support plate and the support arm is obtained by way of tongues 33 formed from the plate 26 and embracing the pin 34 and arranged adjacent the inner faces of the side walls 35 of the U-shaped support arm 23 and, thereby, prevent at the same time sideways sliding of the support plate relative to the support arm. The pin 34 has a projected area much less than the area of the support faces 30, 31 and the tongues 33 have a width which is much less than the overall width of the plate 26. As shown in FIG. 2 the side walls 35 of the support arm are provided with recesses 35' corresponding to the depression 28 of the support plate 26 so that the support plate can be wider than the support arm and at the same time take up the position shown in FIG. 1.

In order to lift the vehicle the handle 22 and with it the threaded spindle 27 are turned so that the support arm 23 comes out of the position shown in FIG. 1 into the position shown in FIG. 2. At the same time the support leg rights itself as it transfers itself from the locating plate 12 over the rolling edge 15 onto the stand plate 14. As this happens the pin 34 lying directly against the underside 36 of the support plate 26 rotates on the support plate which, for its part, lies against the vehicle floor without relative movement thereto. Damage of the underfloor protection of the vehicle floor or its deformation through a load head rotating with respect thereto, whose respective support faces must necessarily be smaller than those of a movable support plate, are avoided.

FIG. 2 shows that the support plate 26 can also be used on the type of vehicle floor 27' which has no support face for the support plate to the right of the seamed joint 29 and which vehicle floor has therefore only a single load point 37 directly over the pin 34. In this case it is necessary that the pin is arranged behind the depression 28 of the support plate with respect to the support leg while the support face 31 of the support plate lying in front thereof can be dispensed with. On the other hand it is possible to arranged the turning pin underneath the support face 31 if it is certain that the motor vehicle to be lifted always has only a support face in front of the fold joint with respect to the support leg. A corresponding body shape is shown in FIG. 4 in which the region 37 of the vehicle floor 27'' is arranged at a higher level than the region 37' of the vehicle floor so that the support surface 31' of the support plate 26' is sufficient for the supporting action and the depression 28' therein serves essentially for the securing of the support plate or of the jack against sliding on the vehicle floor. In this arrangement having a turning pin 34 lying in front of the depression 28' with respect to the support leg the support arm can be kept correspondingly shorter than in the jack of FIG. 1.

Both the support plate 26 of FIGS. 1 to 3 as well as the support plate 26' of FIG. 4 are free of bending moments acting upon them independently of the construction of the vehicle floor and ensure that the load transfer from the vehicle floor to the pin 34 is taken fully and directly from the underside of the vehicle floor in the shortest path and without rolling movements. The spacing of the pin from the vehicle floor is essentially defined by the plate thickness. This is essentially smaller than the plate strength of known movable support plates since the type of loading is more effective and the area of the rolling face available on the underside of the plate for contact with the pin is comparatively larger than that provided by the supporting side walls standing perpendicular to base of the known support plates.

The pivoting movement of the support plates 26, 26' can be limited in both hinging directions when the jack is not set against a vehicle floor. For example, in the clockwise sense as seen in FIGS. 1 to 3 the depression 28 comes up against the support arm and in the anti-clockwise sense the stops 38 on the support plate 26 come up against the front edges of the side walls 35 of the support arm 23. In the FIG. 4 construction, the depression 28' comes up against corresponding front faces of the support arm 23' to limit the anti-clockwise movement. In both cases therefore a downward hanging of the support plate and a corresponding improper establishment of the jack against the vehicle floor are avoided. The operator will hinge the support plate 26 in the clockwise direction and the support plate 26' in the counter clockwise direction in the case that the support plate stands incorrectly before the establishment of the jack against the vehicle floor. The support faces 30, 31, 31' of the support plates then come to lie automatically and securely against sliding against the vehicle floor during upward pressure of the support arm 23, 23'.

I claim:

1. A vehicle jack having a support leg and a support arm pivotably supported on said support leg for movement about a pivot axis by a handle-operated thread spindle running in a spindle nut and a spindle bearing pivotably mounted one in each of the upper end of the support leg and the support arm, the support arm having a support plate at its distal end for use in setting, against a vehicle floor at a load carrying point thereof and is supported on the support arm about an axis of rotation parallel to the said pivot axis, said axis of rotation lying immediately adjacent the underside of the support plate with respect to the vehicle floor; said support plate having a depression for receiving a protrusion of such vehicle floor; said depression being located beside said axis of rotation when said support plate engages such vehicle floor.

2. A vehicle jack having a support leg; a support arm pivotably supported on said support leg for movement about a pivot axis; a handle-operated threaded spindle rotatably mounted on upper end portions of the support leg and the support arm in such manner whereby spindle rotation changes the angular disposition of said support arm relative to said support leg; said support arm having a support plate at its distal end for use in setting against a vehicle floor at a load-carrying point thereof; said support plate being supported on the support arm about an axis of rotation parallel to the said pivot axis; said axis of rotation lying immediately adjacent the underside of the support plate with respect to the vehicle floor; said support plate having a depression for receiving a protrusion of such vehicle floor; said depression being located beside said axis of rotation when said support plate engages such vehicle floor.

3. A jack according to claims 1 or 2 wherein the support plate is provided with a V- or U-shaped depression for a folded portion of a vehicle floor forming said protrusion.

4. A jack according to claims 1 or 2 wherein the said axis of rotation lies behind and adjacent to the depression in the support plate with respect to the support leg.

5. A jack according to claims 1 or 2 wherein the said axis of rotation is immediately adjacent to the depression in the support plate.

6. A jack according to claims 1 or 2 wherein the said axis of rotation is defined by a plate support pin and the area of the support plate for lying against the vehicle floor is large in relation to the projected area of the pin.

7. A jack according to claims 1 or 2 wherein the support plate has support faces for lying against the vehicle floor lying on both sides of the axis of rotation of the support plate.

8. A jack according to claim 7 wherein said depression lies between said support faces.

9. A jack according to claims 1 or 2 wherein two tongues formed out of the support plate extend around means defining said axis of rotation.

10. A jack according to claim 9 wherein the tongues formed out of the support plate are arranged either both against the inner or both against the outer face of the side walls of a Ushaped support arm.

11. A jack according to claims 1 or 2 wherein the support plate has a stop which cooperates with the support arm and limits the possibilities of hinging movement away from the support leg.

12. A jack according to claims 1 or 2 wherein the axis of rotation is defined by a cylindrical pin mounted in the side walls of a U-shaped support arm and rotatably supports the support plate.

13. A jack according to claims 1 or 2 wherein a recess corresponding to the depression in the support plate is present in side wall portions of said support arm.

* * * * *